US006325268B1

(12) United States Patent
Liang

(10) Patent No.: US 6,325,268 B1
(45) Date of Patent: Dec. 4, 2001

(54) VIBRATION CONTROLLING CONSTRUCTION OF A QUICK-RELEASE MEMBER FOR A FASTENING ELEMENT DRIVING TOOL

(76) Inventor: Lin Chi Liang, 5Fl., No. 536-6, Dajin St., Nantuen Chiu, Taichung (TW)

( * ) Notice: Subject to any disclaimer, the term of this patent is extended or adjusted under 35 U.S.C. 154(b) by 0 days.

(21) Appl. No.: 09/843,854

(22) Filed: Apr. 30, 2001

(51) Int. Cl.[7] ..... B25C 1/04
(52) U.S. Cl. ..... 227/123; 227/127
(58) Field of Search ..... 227/123, 127, 227/120, 128

(56) References Cited

U.S. PATENT DOCUMENTS 4,436,236 * 3/1984 Jobe ..... 227/123
4,688,710 * 8/1987 Massari, Jr. et al. ..... 227/120
5,642,849 * 7/1997 Chen ..... 227/127
6,056,182 * 5/2000 Chen ..... 227/123
6,076,722 * 6/2000 Huang ..... 227/123

* cited by examiner

*Primary Examiner*—Scott A. Smith
(74) *Attorney, Agent, or Firm*—Rosenberg, Klein & Lee

(57) ABSTRACT

Disclosed is a vibration controlling construction of a quick-release member for a fastening element driving tool. The tool includes a central plate mounted on a top surface of a magazine of the tool. A detachable quick-release member is mounted on the top surface of the central plate. A trigger is pivotally mounted on the quick-release member and has a locking ring. At least one hook integrally protrudes from the central plate and extends over the quick-release member. A slot is formed on a face and a slope extending from a top edge of the slot. A controlling member is received in the slot of the hook. The controlling member includes a slant so configured to correspond to the slope of the hook to abut upon the slope.

2 Claims, 5 Drawing Sheets

VIBRATION CONTROLLING CONSTRUCTION OF A QUICK-RELEASE MEMBER FOR A FASTENING ELEMENT DRIVING TOOL

BACKGROUND OF THE INVENTION

1. Field of the Invention

The present invention relates to a vibration controlling construction of a quick-release member for a fastening element driving tool, and more particularly to an improved vibration controlling construction of a quick-release member applicable to the field of the fastening element driving tools.

2. Description of the Related Prior Art

A conventional quick release device for a fastening element driving tool as shown in FIG. 5 is disclosed including a locking ring 55 of a trigger 54. The locking ring 55 is so configured to lock the hook 52. However, the horizontal component force exerted to the locking ring 55 when it is locked is more than the vertical component force exerted to it. In such a configuration, when the conventional fastening element driving tool is actuated, the recoil force will cause the central plate 51 together with the hook 52 to slightly vibrate in horizontal direction as shown by two arrows in FIG. 5. However, there is no normal force between the quick-release member 53 and the central plate 51 to allow them to come to abut to each other closely Therefore, when central plate 51 and hook 52 vibrate the locking ring 55 will be pulled and then released immediately after time. After a certain period of time, the locking ring 55 will be easily broken due to fatigue by vibration. In such a situation, a trouble in maintenance or substitution of the quick-release member 53 is often caused.

SUMMARY OF THE INVENTION

However, it is found a disadvantage in the subject matter of the above-mentioned prior art that the locking ring will be easily broken due to fatigue by the vibration.

Thus, there is still a need for improving the subject matter of prior art.

Therefore, an object of the present invention is to provide a vibration controlling construction of a quick-release member for a fastening element driving tool. The vibration controlling construction can exactly and constantly provide a normal force from a controlling member so as to reduce the chance of the fatigue of the quick-release member to extend the life of the quick-release member.

To accomplish the object of the present invention, the construction includes a central plate mounted on a top surface of a magazine of the tool. A detachable quick-release member is mounted on the top surface of the central plate. A trigger is pivotally mounted on the quick-release member and has a locking ring. At least one hook integrally protrudes from the central plate and extends over the quick-release member to form a protrusion. The hook has a slot formed on a face thereof and a slope extending from a top edge of the slot. The slot of the hook has a controlling member received therein. The controlling member includes a bottom surface abutting upon the face of the quick-release member. a slant formed on a first position corresponding to the slope of the hook to abut upon the slope of the hook, and a second position located to form a lock relationship with the locking ring.

The other object of the present invention is to provide a simple structured, suppressing-orientation-exact, and quickly detachable controlling member for a quick release member of a fastening element driving tool To accomplish this object of the present invention, the second position of the controlling member has a locking slot and the locking ring is so configured that it can be locked by the locking slot.

BRIEF DESCRIPTION OF THE DRAWINGS

The other advantages and/or benefits caused by the present invention will become patently apparent after reading the following detailed description of an illustrative preferred embodiment of the invention together with referring to the associated drawings in which.

DETAILED DESCRIPTION OF THE INVENTION

Figure 1:
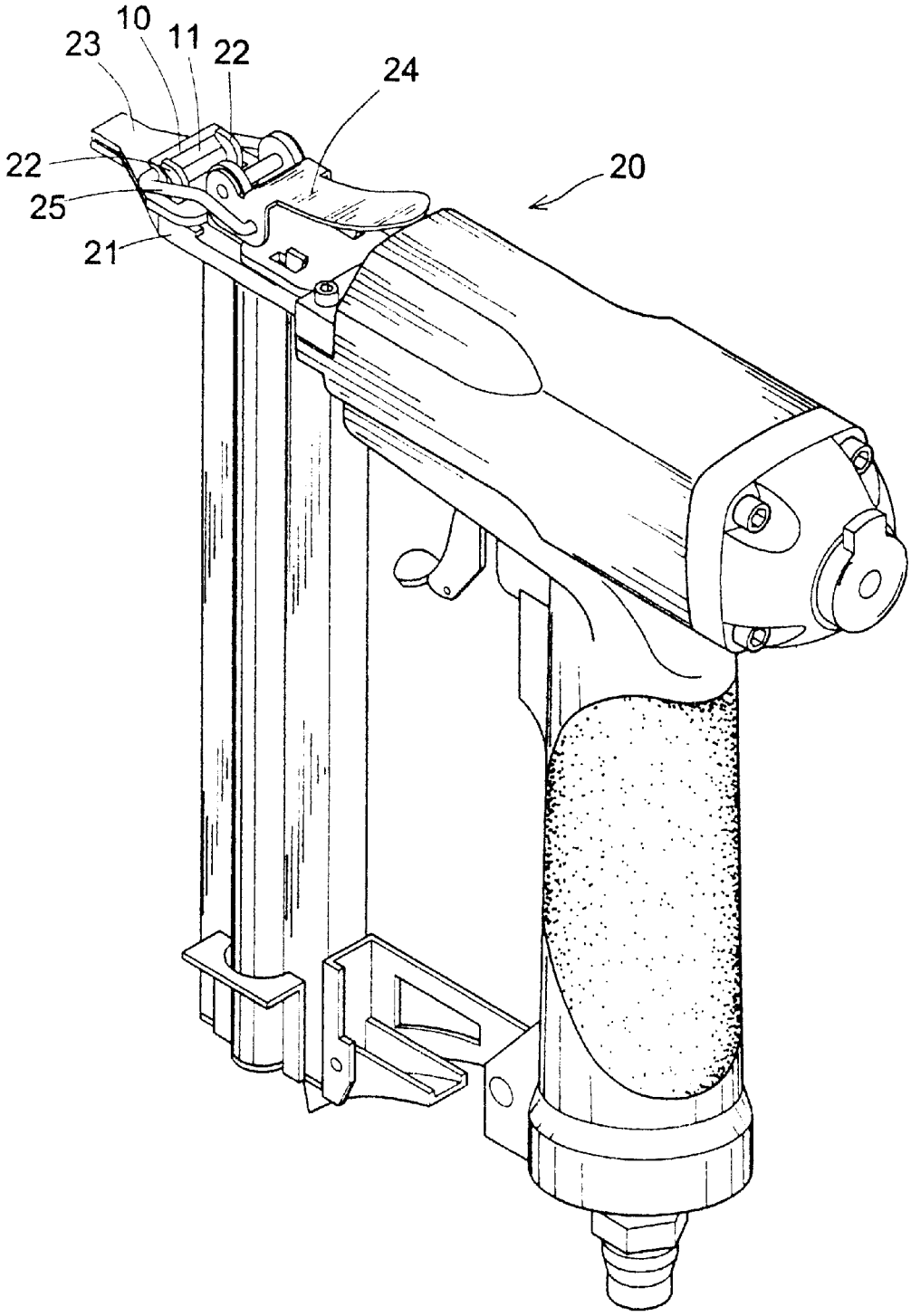
FIG. 1 is a perspective view of a preferred embodiment of a vibration controlling construction of a quick-release member for a fastening element driving tool in accordance with the present invention.
Figure 2:
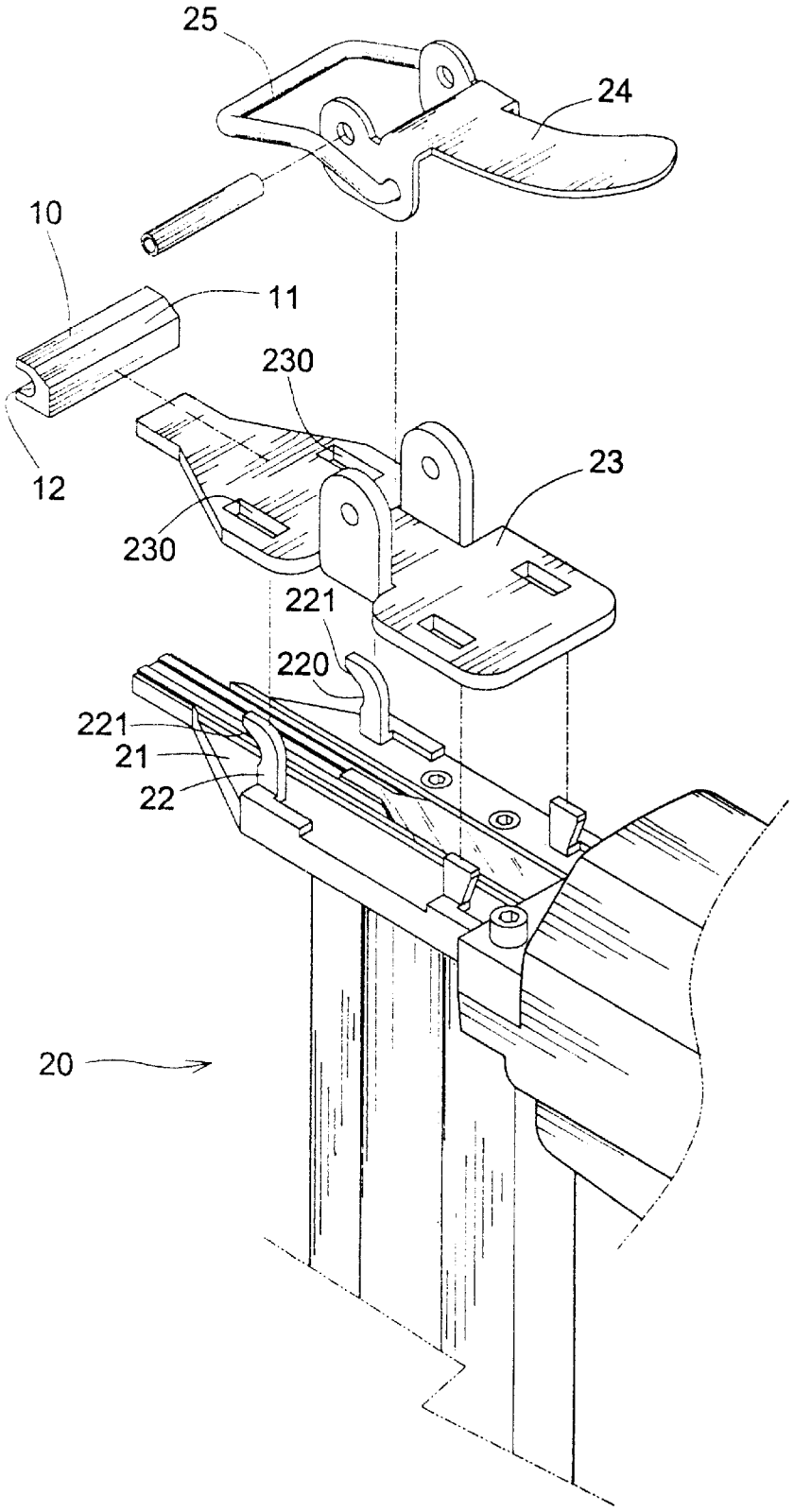
FIG. 2 is an exploded view of the vibration controlling construction of FIG. 1.
Figure 3:
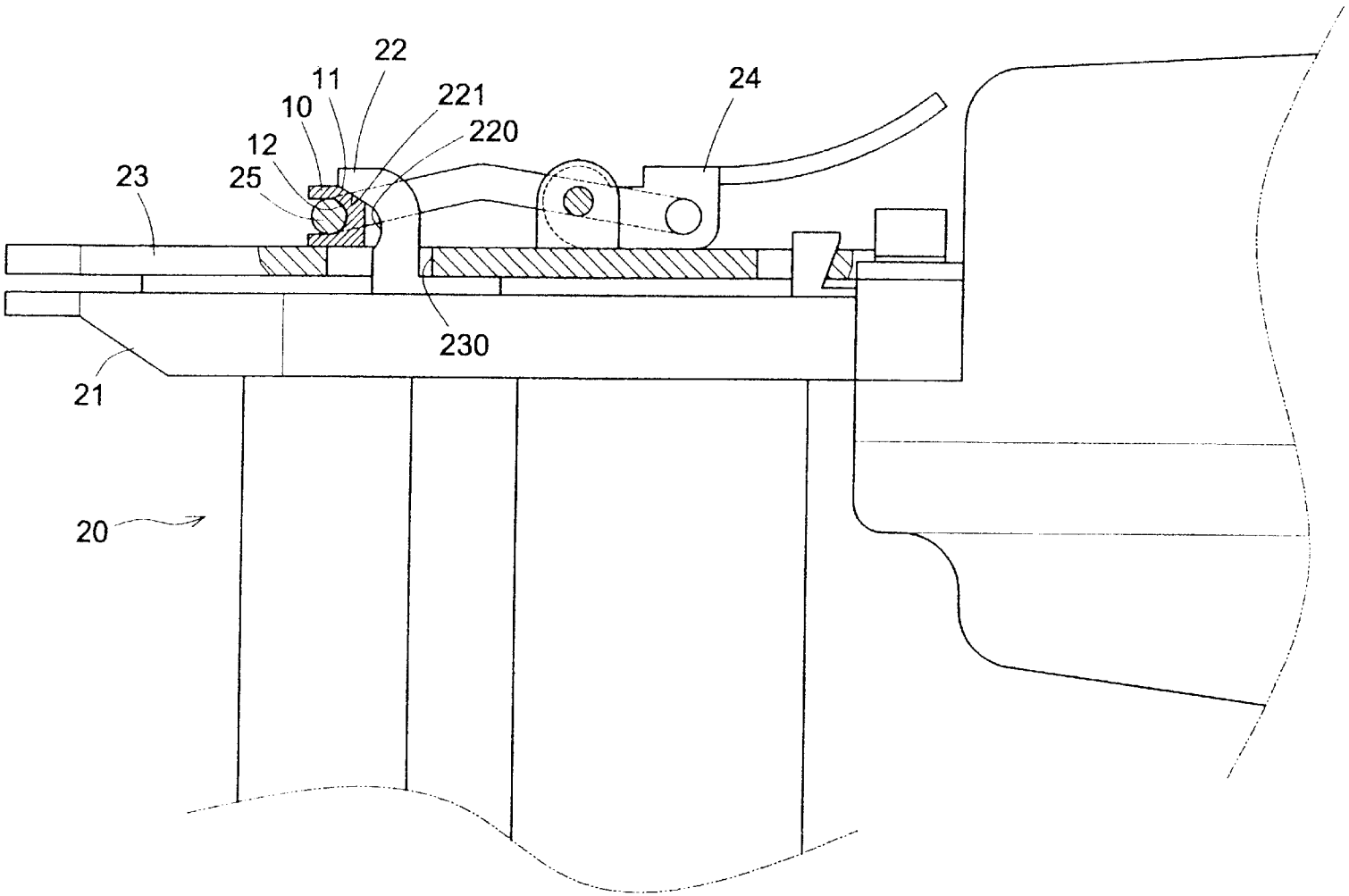
FIG. 3 is a cross-sectional view of the vibration controlling construction of FIG. 1.

With reference to FIGS. 1, 2 and 3, a preferred embodiment of the vibration controlling construction of a quick-release member for a fastening element driving tool in accordance with the present invention includes a central plate 21, a quick release member 23, a trigger 24, at least one hook 22 and a controlling member 10.

The central plate 21 is mounted on a top surface of a magazine of the fastening element driving tool. The central plate has a top surface thereon.

Two parallel hooks 22 each extend integrally from the top surface of the hook 22. Each hook 22 has a slot 220 located on a face facing to the distal end of the fastening-element-ejecting-orifice of the central plate 21 of the tool. On the top of the slot 220 of each hook 22, a slope 221 integrally extends from the top edge of the slot 220.

The quick-release member 23 is detachably mounted on the top surface of the central plate 21. The quick-release member 23 has a face facing the central plate 21. The quick-release member 23 also has a top surface.

Two openings 230 are excavated on the quick-release member 23 to correspond to two hooks 22 of the central plate 21, respectively. Therefore, each one of the two hooks 22 is allowed to pass through two opening 230, respectively.

The trigger 24 is pivotally mounted on the quick-release member 23 at a side opposite to the side where the hooks 22 are formed. A locking ring 25 is pivotally mounted on the trigger 24.

The controlling member 10 is received in the slots 220 of the two hooks 22 of the central plate 21. The controlling member 10 has a bottom surface, a slant 11 and a second position.

The controlling member 10 has a bottom surface abutting upon the top surface of the quick-release member 23. A slant 11 is formed on the first position corresponding to the slope 221 of the hook 22 to abut upon the slope 221 of the hook 22. The second position is located to form a lock relationship with the locking ring 25. More particularly, the second position of the controlling member has a locking slot and the locking ring is so configured to have a wire diameter to allow the ring to fit in the locking slot 12.

When the preferred embodiment of the vibration controlling construction of a quick-release member for a fastening element driving tool in accordance with the present invention as described above is made into practice, the quick-release member 23 is bring to cover over the central plate 21. Therefore, the hook 22 of the central plate 21 can pass through the opening 230 of the quick-release member 23. Afterward, the bottom surface of the controlling member 10 abuts to the top surface of the quick-release member 23. Meanwhile, the side of the controlling member 10, which includes the slant 11, is fit into the slot 220 of the two hooks 22. At this moment, the slant 11 of the controlling member 10 abuts to the slope 221 on the top edge of the slot 220. Subsequently, the locking ring 25 of the trigger 24 is so moved to encircle the controlling member 10 of the hook 22 and the front part of the wire diameter of the locking ring 25 is fit into the locking slot 12 of the controlling member 10. Then, the trigger 24 is moved to pull the locking ring 25 so that the controlling member 10 is stably fit into the slot 220. In this way, the slant 11 of the controlling member 10 is closely abutted to the slope 221 of the hook 22.

Figure 4:
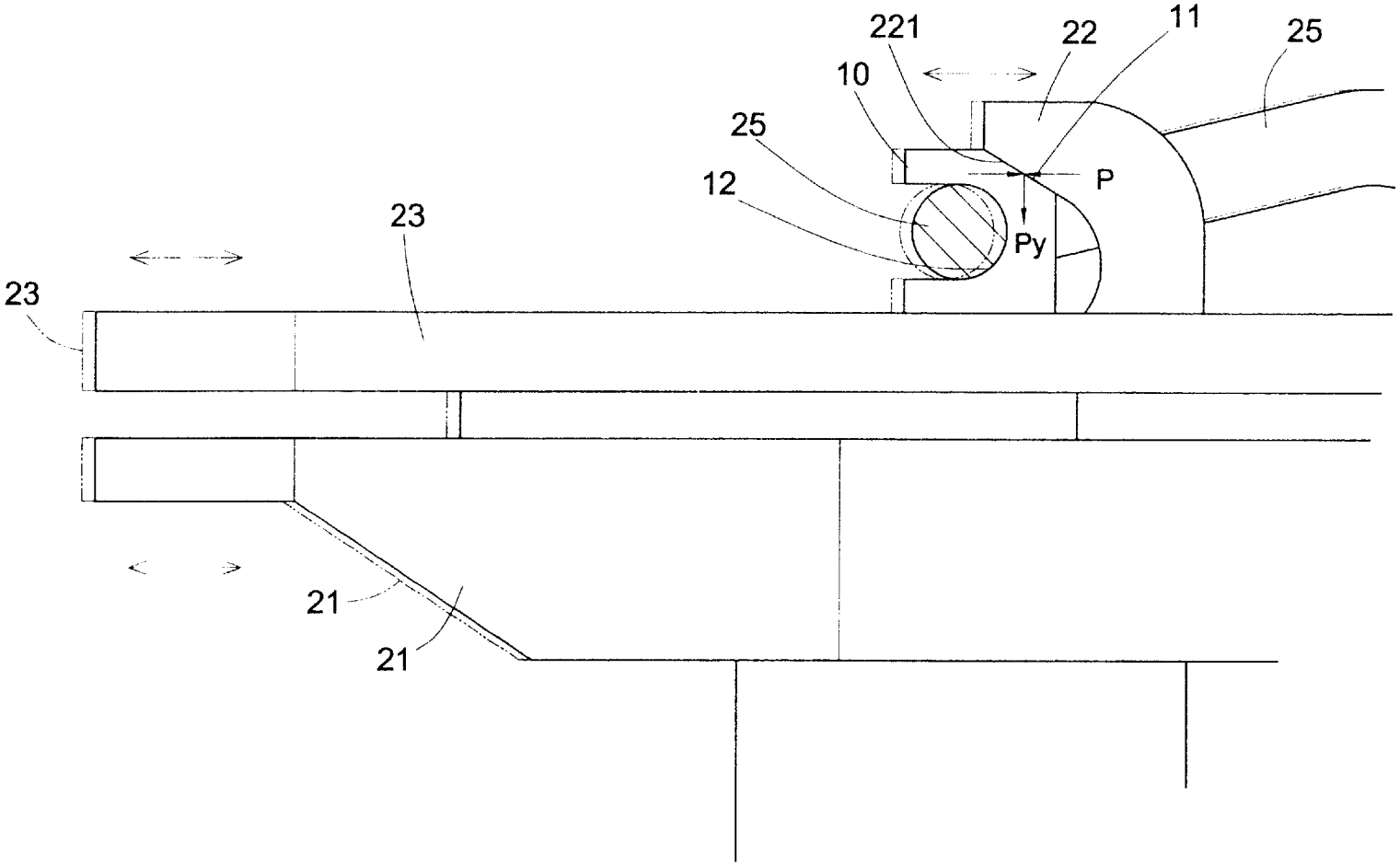
FIG. 4 is a schematic cross-sectional view of the vibration controlling construction of FIG. 1 to explain the suppressing situation of the vibration controlling construction.
Figure 5:
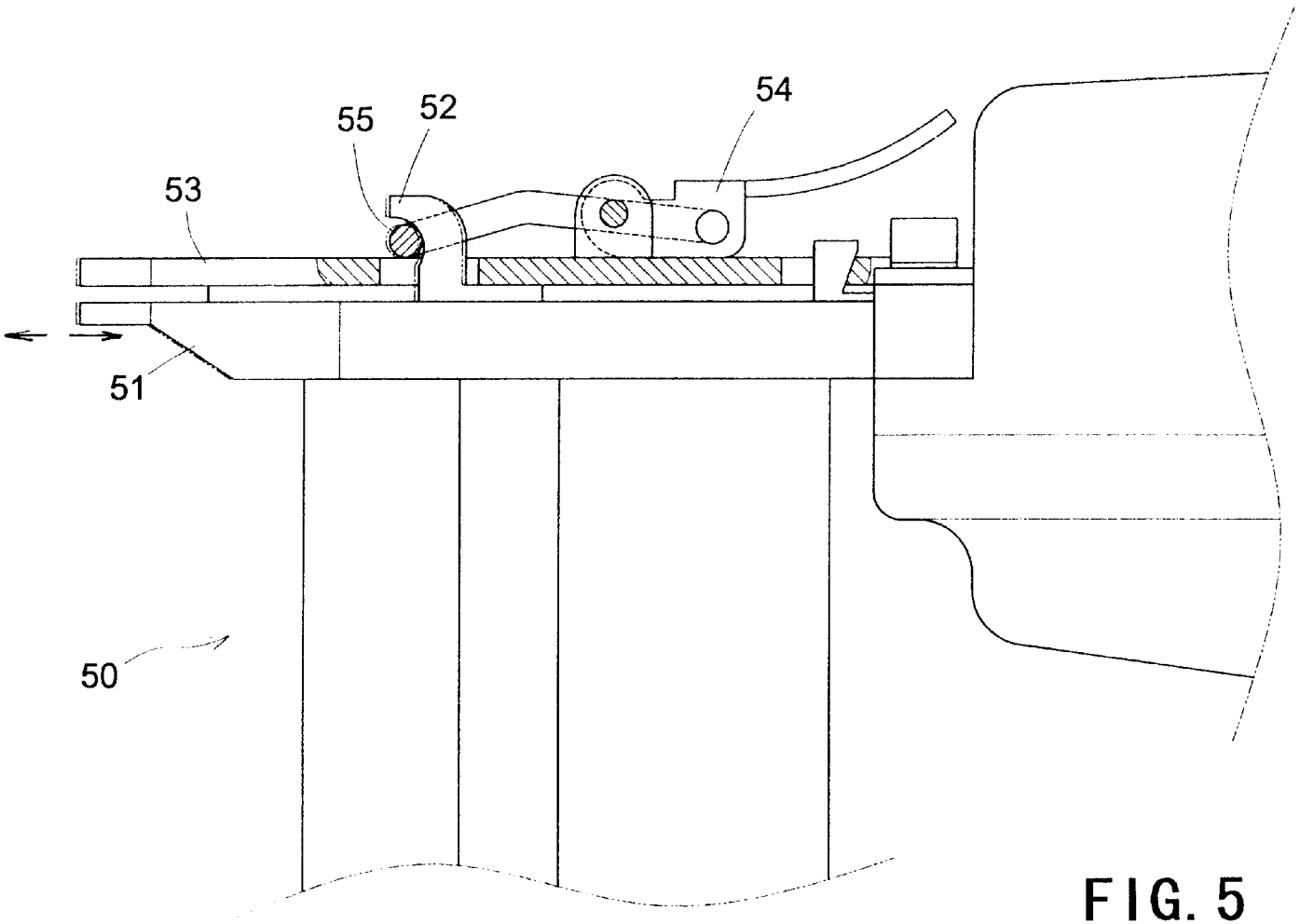
FIG. 5 PRIOR ART
FIG. 5 is a cross-sectional view of a quick-release device of prior art.

With reference to FIG. 4, the controlling member 10 in accordance with the present invention has the slant 11 which comes to closely abut to the slope 221 of the hook 22. Thus, when a fastening element driving tool equipped with the vibration controlling construction of a quick-release member in accordance with the present invention is actuated, the recoil force will cause the central plate 21 together with the hook 22 to slightly vibrate in horizontal direction (as shown by the arrows in FIG. 4). The horizontal vibration force P will be passed to the slant 11 of the controlling member 10 through the slope 221 of the hook 22. At this moment, through the help of the slope 11 of the controlling member 10, a downward component force Py is formed toward the quick-release member 23 to suppress the quick-release member 23. With this downward suppressing force Py, when the tool is in use to cause vibration, the controlling member 10 an provide the downward force to allow the quick-release member 23 to abut to the central plate more closely. Thus, the quick-release member 23 and central plate 21 will horizontally vibrate together. No relative movement of the quick-release member 23 to the central plate 21 will occur. In this way, the locking ring 25 will not suffer from the force caused by the vibration when the tool is in use, either. Thus, the life of the locking ring 25 of the quick-release member 23 is extended and the maintenance time can be reduced. In brief, the disadvantage of prior art can be improved by the vibration controlling construction of a quick-release member in accordance with the present invention.

Having thus detailedly described the preferred embodiment of the present invention, it will become apparently to those skilled in the art that the detailed description of the preferred embodiment of the present invention is illustrative only and thus various modifications, changes and substitutions can be made without departing from the spirit of the following claims of the present invention. All of such modifications, changes and substitution as stated above are still within the scope of the present invention.

What is claimed is:

1. A vibration controlling construction of a quick-release member for a fastening element driving tool, comprising a central plate (21) mounted on a top surface of a magazine of the fastening element driving tool and having a top surface thereon;

a quick-release member (23) detachably mounted on the top surface of the central plate (21) and having a face thereof;

a trigger (24) pivotally mounted on the quick-release member (23) and having a locking ring (25) pivotally mounted thereon;

at least one hook (22) integrally protruding from the central plate (21) and extending over the quick-release member (23) to form a protrusion, the hook (22) having a slot (220) formed on a face thereof and a slope (221) extending from atop edge of the slot (221); and a controlling member (10) received in the slot (220) of the hook (22) and comprising a bottom surface abutting upon the face of the quick-release member (23), a slant (11) formed on a first position corresponding to the slope (221) of the hook (22) to abut upon the slope (221) of the hook (22), and a second position located to form a lock relationship with the locking ring (25).

2. The vibration controlling construction of a quick-release member for a fastening element driving tool as claimed in claim 1, wherein the second position of the controlling member (10) having a locking slot (12) and the locking ring (25) is so configured that a wire diameter thereof allows the locking ring (25) to be locked by the locking slot (12).

* * * * *